US009391431B2

(12) United States Patent
Okabe et al.

(10) Patent No.: US 9,391,431 B2
(45) Date of Patent: Jul. 12, 2016

(54) BARRIER DISCHARGE IGNITION APPARATUS FOR INTERNAL COMBUSTION ENGINE

(71) Applicant: DENSO CORPORATION, Kariya, Aichi-pref. (JP)

(72) Inventors: Shinichi Okabe, Aichi-ken (JP); Yoshihiro Nakase, Okazaki (JP); Akimitsu Sugiura, Nagoya (JP); Yuya Abe, Nagoya (JP)

(73) Assignee: DENSO CORPORATION, Kariya (JP)

( * ) Notice: Subject to any disclaimer, the term of this patent is extended or adjusted under 35 U.S.C. 154(b) by 320 days.

(21) Appl. No.: 14/093,096

(22) Filed: Nov. 29, 2013

(65) Prior Publication Data

US 2014/0144402 A1 May 29, 2014

(30) Foreign Application Priority Data

Nov. 29, 2012 (JP) ..... 2012-260806

(51) Int. Cl.
*H01T 13/20* (2006.01)
*H01T 13/52* (2006.01)
*H01T 13/46* (2006.01)

(52) U.S. Cl.
CPC ..... *H01T 13/52* (2013.01); *H01T 13/467* (2013.01)

(58) Field of Classification Search
CPC ..... H01T 21/02; H01T 13/20; F02P 9/007
USPC ..... 313/141, 130, 137, 143, 145
See application file for complete search history.

(56) References Cited

U.S. PATENT DOCUMENTS 4,439,707 A * 3/1984 Hattori ..... H01T 13/39 313/130
5,469,013 A 11/1995 Kang
2008/0141967 A1* 6/2008 Tani ..... F02P 9/007 123/143 B

FOREIGN PATENT DOCUMENTS

JP 2009-036125 2/2009
JP 2010-037949 2/2010

OTHER PUBLICATIONS

Office Action (1 page) dated Oct. 6, 2015, issued in corresponding Japanese Application No. 2012-260806 and English translation (1 page).

* cited by examiner

*Primary Examiner* — Vip Patel
(74) *Attorney, Agent, or Firm* — Nixon & Vanderhye P.C.

(57) ABSTRACT

A barrier discharge ignition apparatus has a tip end exposed to a combustion chamber of an internal combustion engine and, when subjected to a high-frequency high-voltage AC burst, generates streamer discharges for igniting a fuel/air mixture in the combustion chamber. A central electrode of the apparatus, covered by a dielectric layer and coaxially enclosed in a ground electrode, extends into the combustion chamber to a greater distance than the ground electrode. An electrode portion close to the tip end of the inner periphery of the ground electrode protrudes towards the dielectric layer, for creating a localized high-density electric field. The streamer discharges thereby enter both the to combustion chamber and also a discharge chamber of the ignition apparatus.

13 Claims, 8 Drawing Sheets

COMPARISON EXAMPLE 1

COMPARISON EXAMPLE 2

COMPARISON EXAMPLE 3

BARRIER DISCHARGE IGNITION APPARATUS FOR INTERNAL COMBUSTION ENGINE

CROSS-REFERENCE TO RELATED APPLICATIONS

This application is based on and incorporates herein by reference Japanese Patent Application No. 2012-260806 filed on Nov. 29, 2012.

BACKGROUND OF THE INVENTION

1. Field of Application

The present invention relates to a barrier discharge type of ignition apparatus for an internal combustion engine.

2. Background Technology

In recent years, internal combustion engines have become required to achieve is lower fuel costs and decreased levels of $CO_2$ emission. To achieve this, high-efficiency engines are being developed which provide high output power but are small in size, and produce low amounts of NOx (nitrogen oxides) emissions. Such engines require techniques such as turbocharging or supercharging, higher compression ratio, higher air/fuel ratio, etc. However such techniques result in an environment within the combustion chamber which renders it difficult to reliably and quickly achieve ignition at the required ignition timings, using conventional types of ignition apparatus. There is thus a requirement for a new type of ignition apparatus which can overcome this difficulty.

One such new type of ignition apparatus is a barrier discharge (also known as dielectric-barrier discharge) ignition apparatus, having two axially extending electrodes, one circumferentially enclosed in the other, with a layer of dielectric material formed over one of the opposing surfaces of the two electrodes. The space between the electrodes is exposed to the combustion chamber of an internal combustion engine. When a short-duration high-frequency high-voltage AC burst is applied between the center electrode and outer electrode from a high-voltage AC power source, a plasma is formed in the gap between the electrodes, for igniting a fuel-air mixture within the combustion chamber and thereby igniting the mixture within the combustion chamber.

Such a barrier discharge ignition apparatus is disclosed in Japanese patent publication No. 2010-37949 (referred to in the following as reference document 1). The inventor proposes an improved barrier discharge ignition apparatus in which the discharge gap between the electrodes of the device (i.e., separation distance between one electrode and the dielectric layer formed on the opposing electrode) is varied along the longitudinal (axial) direction of the device. However it has been found by the assignees of the present invention and others based upon results from extensive testing of devices configured as described in reference document 1, that with such a configuration, the energy which is discharged in the discharge gap is not effectively utilized in effecting ignition.

Furthermore, it has been found that to achieve a high lean-limit A/F ratio (where "lean-limit A/F ratio" signifies the maximum value of air-to-fuel ratio for which stable to ignition can be achieved) it is necessary for a substantially high AC frequency to be generated by the high-voltage AC power supply. The use of a high frequency is undesirable, since only a limited amount of electrical power is available on a motor vehicle, and the electrical energy applied to effect ignition should be used as efficiently as possible. Since the energy is consumed by the ignition apparatus in producing momentary is discharges (streamer discharges) which are synchronized with the peaks of the AC voltage, the higher the frequency, the greater becomes the amount of power that must be supplied from the high-voltage AC power source. In addition, the manufacturing cost of the power source will rise in accordance with increase of the required AC frequency.

It has been found by the assignees of the present invention that these disadvantages are basically due to the fact that the tip of the center electrode does not protrude beyond the tip end of the outer (ground potential) electrode. Hence the discharge space within which the plasma is generated is separated (with respect to the axial direction) from the tip end of the outer electrode, and so is not directly exposed to the interior of the combustion chamber.

Furthermore when the size of the discharge gap varies along the axial (elongation) direction of the device, as with the type of device proposed in document 1, there is only a probability that discharge will occur at any specific gap position. In particular since the combustion chamber pressure at the ignition timing will vary, when the engine runs under various different operating conditions, it cannot be ensured that discharge will occur at any particular gap position, even if other conditions remain unchanged. Hence it becomes difficult to ensure satisfactory ignition performance.

Furthermore, with the type of device proposed in document 1, when there is a change in the (axial) position of the discharge space, due to a change to a different discharge gap, then (as can be understood from FIGS. 4 and 6 of document 1 for example), the volume of the discharge space will vary accordingly. However it is important to set an appropriate size for the discharge space. Specifically, if the volume of the discharge space exceeds a certain value (for example, 300 $mm^3$), the electrical energy expended within the discharge space will not be used effectively to ignite the fuel/air mixture. Hence there can be a substantial waste of electrical energy.

It has further been found that with the type of ignition apparatus proposed in document 1, when discharge occurs and an initial-stage combustion flame is produced by ignition of the fuel/air mixture, the flame does not immediately propagate to the interior of the combustion chamber. This delay during which the flame remains within the discharge space may result in overheating of the dielectric material, which can cause pre-ignition.

SUMMARY

Hence it is desired to overcome the above problems by providing an improved is ignition apparatus for an internal combustion engine (referred to in the following simply as "engine"). With such an apparatus, when an appropriate AC voltage is applied between a ground electrode and a center electrode covered by a dielectric body, and a non-uniform plasma is thereby generated within a discharge space between the ground electrode and dielectric body and directly reacts with a fuel/air mixture within the discharge space, thereby producing an initial-stage flame for effecting ignition in a combustion chamber of the engine, the discharged electrical energy is concentrated within a specific region, such as to be effectively utilized. Improved ignition performance is thereby achieved.

More specifically, in addition to an externally provided AC power supply for applying the aforementioned AC voltage at required timings, the ignition apparatus includes an axially elongated center electrode, a central dielectric body covering the center electrode, and a ground electrode having a hollow cylindrical portion which coaxially encloses the central dielectric body, separated therefrom by a first discharge gap. Respective tip ends of the central dielectric body and the ground electrode are exposed to the interior of a combustion chamber of the engine (where "tip end" signifies an end which is closest to the interior of the combustion chamber). At each ignition timing, the AC voltage is applied between the center electrode and the ground electrode. A cylindrical tip portion of the central dielectric body, extending to the tip end of that dielectric body, has a smaller external diameter than the remaining part of the central dielectric body A first discharge space, having a first discharge gap, is thereby formed between the cylindrical portion of the ground electrode and the cylindrical tip portion of the central dielectric body. An annular-shape tip portion of the ground electrode, extending to the tip end of that electrode, is open to the interior of the combustion chamber and protrudes into the combustion chamber for a specific protrusion distance.

It is a feature of the invention that a ground electrode protrusion portion, having a specific axial-direction width, is disposed around the inner circumferential face of the tip portion of the ground electrode, adjacent to the tip end of the ground electrode, with at least part of the inner circumferential face of the ground electrode protrusion portion protruding towards the cylindrical tip portion of the central dielectric body. A second discharge space, having a second discharge gap, narrower than the first discharge gap, is thereby formed between the ground electrode protrusion portion and the cylindrical tip portion of the central dielectric body, with the second discharge space extending axially from the tip end of the first discharge space.

It is further a feature of the invention that a discharge portion of the center electrode, which extends to the tip end of the center electrode, protrudes into the combustion chamber for a greater distance than the protrusion distance of the ground electrode tip portion.

The frequency of the AC voltage is set within the range from 85 kHz to 850 kHz, and the volume of the first discharge space is made no greater than 300 $mm^3$. The axial position of the ground electrode protrusion portion is set approximately midway along the cylindrical tip portion of the central dielectric body.

With such an ignition device, by providing the ground electrode protrusion portion, a localized region is formed in which (due to the proximity of the circumference of the ground electrode protrusion portion to the discharge portion of the center electrode) an electric field becomes concentrated, when the AC voltage is applied. Specifically, the electric field is concentrated within a suitable range of axial positions on that discharge portion. As a result, streamer discharges are readily produced between the ground electrode protrusion portion and the surface of the cylindrical tip portion of the central dielectric body.

In addition, due to the respective axial positions of the ground electrode protrusion portion and the discharge portion of the center electrode (i.e., with the discharge portion of the center electrode protruding into the combustion chamber to a greater extent) it is ensured that the axial range of positions where the streamer discharges attain the surface of the cylindrical tip portion of the central dielectric body extends into the first discharge space and also into the interior of the combustion chamber. Due to these factors, and by limiting the volume of the first discharge space to an appropriate size, effective ignition of a fuel/air mixture can be ensured.

The assignees of the present invention and others have found, based on careful testing, that such an ignition device enables stable ignition to be attained at a high value of air/fuel ratio, for a wide range of AC frequency values, i.e., from 85 kHz to 850 kHz.

DESCRIPTION OF PREFERRED EMBODIMENTS

An ignition apparatus according to the present invention consists of a combination of a device having electrodes, for producing electrical discharges to ignite a fuel/air mixture, and a separately provided AC power supply. However for convenience in describing embodiments, "ignition apparatus" in the following is to be understood as signifying the is device having electrodes, unless otherwise indicated.

Figure 1:
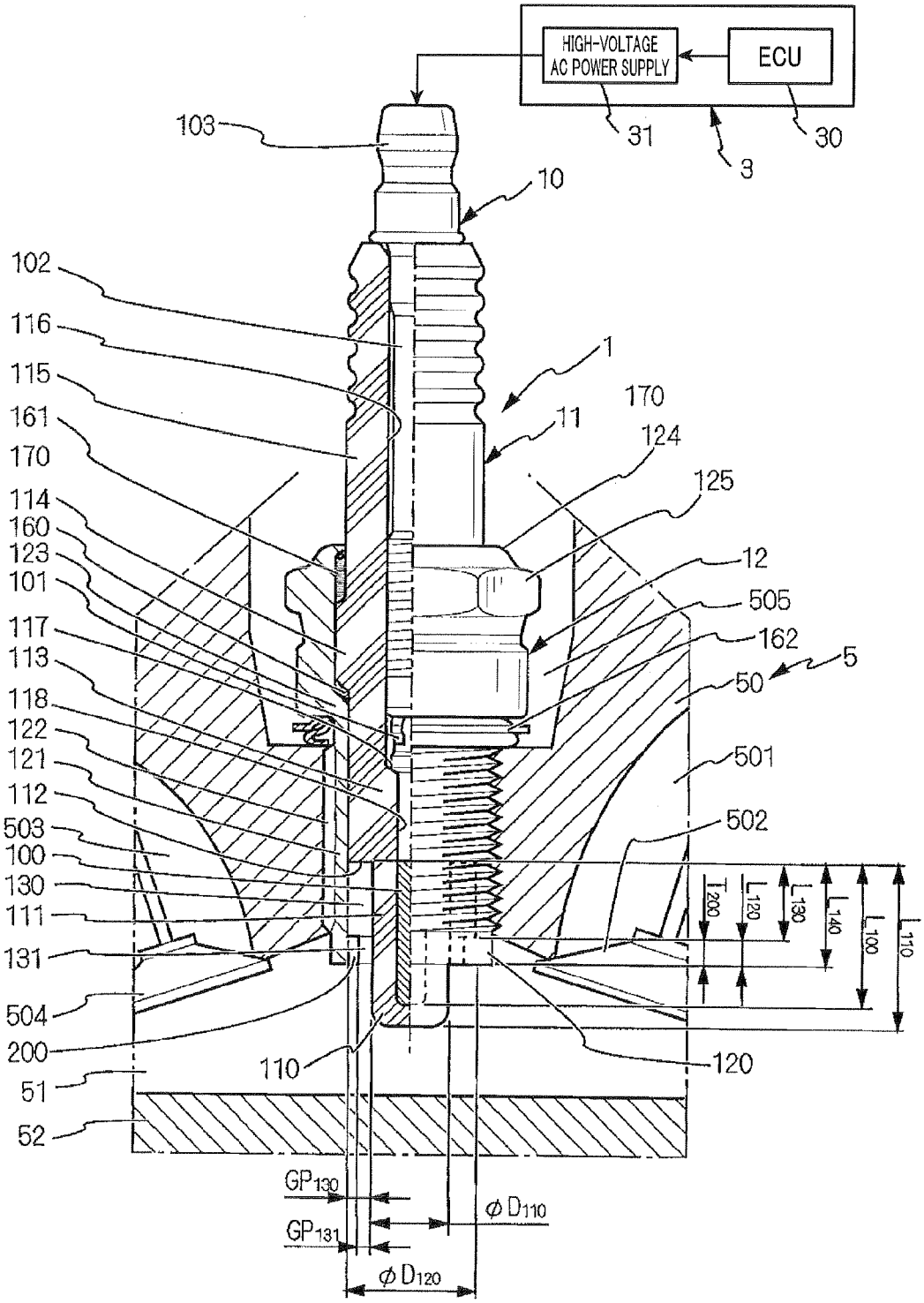
FIG. 1 is a diagram taken partly in cross-section, showing the overall configuration of a first embodiment of an ignition apparatus.
Figure 3:
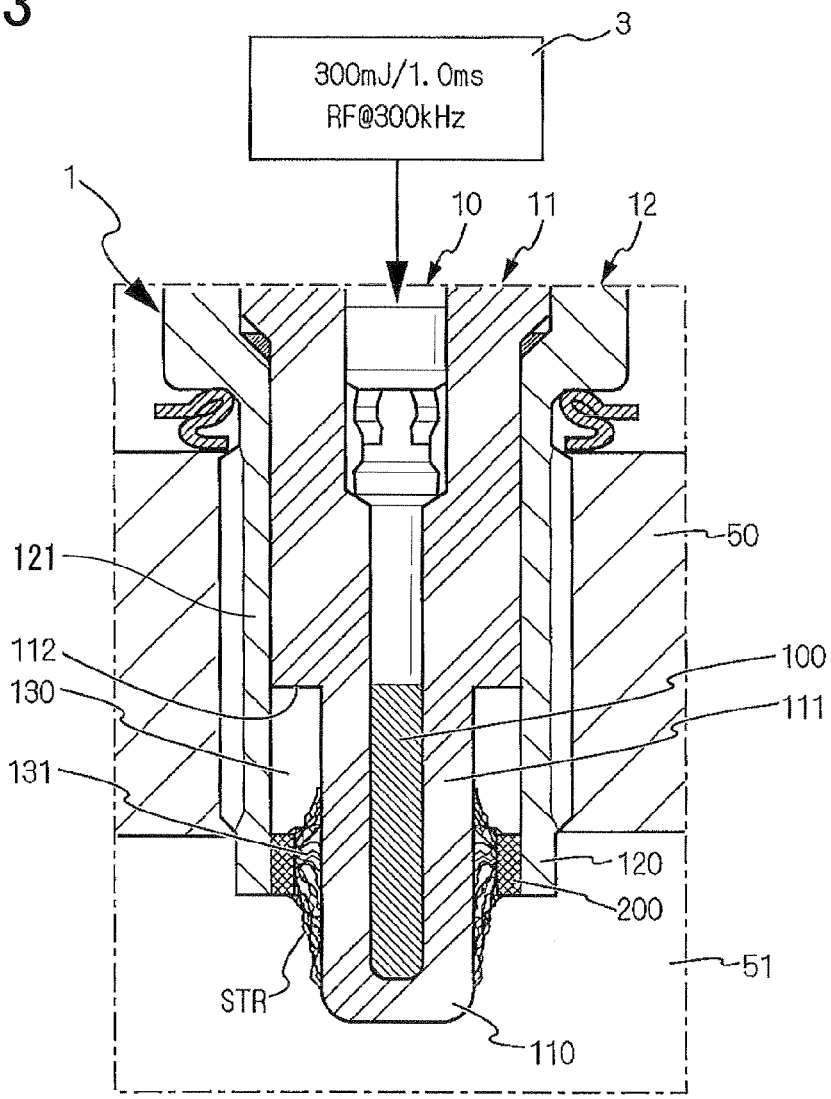
FIG. 3 is a partial cross-sectional view showing the main components of the first embodiment, and illustrating the effects provided by the embodiment with respect to size and location of an electric discharge.

FIG. 1 is a view taken partially in cross-section, showing the overall configuration of a first embodiment of an ignition apparatus, designated by numeral 1. FIG. 3 is a corresponding partial cross-sectional view, showing details of first and second discharge spaces and illustrating the distribution of streamer discharges (indicated as STR) which are generated by the embodiment.

As shown in FIG. 1 the ignition apparatus 1 is installed in an engine 5, with one end of the ignition apparatus 1 exposed to the interior of a combustion chamber 51 of the engine 5, and includes at least a central dielectric body 11, a center electrode 10 and a ground electrode 12. The ignition apparatus 1 is connected to receive a high-frequency high-voltage output from a high-voltage AC power supply of an external power supply 3. The engine 5 is a type of engine designed to provide high efficiency and low levels of NOx emissions, and for which ignition is difficult to achieve, such as a turbocharged or supercharged engine, an engine having a high compression ratio, an engine which applies EGR (exhaust gas regeneration), a lean-combustion engine (i.e., which operates with exceptionally high air/fuel ratio), etc.

In the following description of the ignition apparatus 1 and other embodiments, and in the appended claims, the term "axial direction" is used to signify a direction parallel to the elongation axis of the ignition apparatus, the term "tip end" of a component or region of the ignition apparatus is used to signify a position (on the component, or in the region) that is axially closest to the interior of the combustion chamber 51, and the term "tip portion" is used to signify a portion which extends to the tip end, the term "base end" is used to signify a position that is axially farthest from the interior of the combustion chamber 51 and the term "base portion" is used to signify a portion which extends to the base end.

The central dielectric body 11 is of basically hollow cylindrical form, and covers the center electrode 10, which is of basically elongated cylindrical form. The ground electrode 12 includes a hollow cylindrical portion 121 which coaxially surrounds a dielectric body cylindrical tip portion 111 (described hereinafter) by a gap designated as the first discharge to gap $GP_{130}$.

Figure 2:
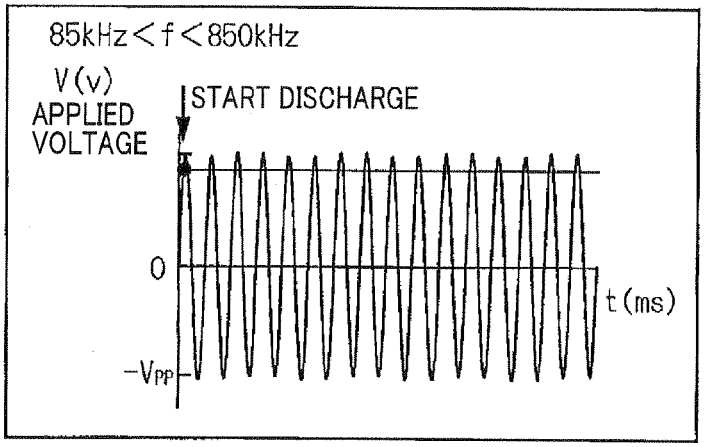
FIG. 2 is a waveform diagram of a drive voltage produced by a high-frequency electrical power source used with the first embodiment.

At each ignition timing of the engine cylinder corresponding to the ignition apparatus 1, the high-voltage AC power supply generates a predetermined high-frequency (preferably in the range 85 kHz to 850 kHz) high-voltage (preferably in the range 20 kV to 50 kV) output, as a short-duration burst having the form shown in the waveform diagram of FIG. 2, which is applied between the center electrode 10 and the ground electrode 12.

The dielectric body cylindrical tip portion 111 protrudes into the interior of the combustion chamber 51 and is formed with a smaller external diameter than a remaining portion of the central dielectric body 11. The tip end of the cylindrical tip portion 111 is terminated by a dielectric termination portion 110. A part of the surface of the central dielectric body 11, designated as the discharge space base face 112, connects (extends between) the outer periphery of the 111 and the inner periphery of the ground electrode cylindrical portion 121.

The ground electrode cylindrical portion 121 is terminated by an annular-shaped portion, designated as the ground electrode tip portion 120, which extends to the tip of the ground electrode 12 and protrudes beyond the internal face of the cylinder head 50, into the combustion chamber 51, for a predetermined distance (L120, shown in FIG. 1). A ground electrode protrusion portion 200, of annular shape and formed of electrically conductive material, is disposed on the inner circumferential face of the ground electrode tip portion 120 (i.e., protruding radially towards the dielectric body cylindrical tip portion 111), positioned adjacent to the tip end of the ground electrode 12.

A first discharge space 130 of hollow cylindrical shape having a first discharge gap $GP_{130}$ is thereby defined, extending axially between the discharge space base face 112 and the ground electrode protrusion portion 200, the first discharge gap $GP_{130}$ being the separation distance between opposing circumferential faces of the ground electrode cylindrical portion 121 and the dielectric body cylindrical tip portion 111.

A second discharge space 131 of annular shape having a second discharge gap $GP_{131}$ is defined between the inner circumferential face of the ground electrode protrusion portion 200 and the diametrically opposing part of the outer circumferential face of the dielectric body cylindrical tip portion 111, i.e., the second discharge gap $GP_{131}$ being the separation distance between opposing circumferential faces of the ground electrode cylindrical portion 121 and the cylindrical tip portion 111.

The second discharge gap $GP_{131}$ is thus narrower than the first discharge gap $GP_{130}$, and the second discharge space 131 extends from the tip end of the first discharge space 130 to the interior of the combustion chamber 51.

The axial-direction width of the ground electrode protrusion portion 200 is designated as the protrusion portion formation width $T_{200}$. A portion extending to the tip end of the center electrode 10, designated as the center electrode discharge portion 100, is covered by the dielectric body cylindrical tip portion 111. The dielectric termination portion 110 covers the tip of the center electrode 10. The region of the center electrode discharge portion 100 which is serves in producing barrier discharges is indicated by cross-hatching in FIG. 3.

It is a feature of this embodiment that a part of the center electrode discharge portion 100 extends into the interior of the combustion chamber 51 (beyond the internal surface of the cylinder head 50) for a greater distance than does the ground electrode tip portion 120, i.e., the tip end of the center electrode 10 protrudes into the combustion chamber 51 to a greater distance than does the tip end of the ground electrode 12.

The axial position of the ground electrode protrusion portion 200 is approximately midway along the cylindrical tip portion 111. This position facilitates the concentration of electric field at the ground electrode protrusion portion 200, and facilitates reaction between the fuel/air mixture and the streamer discharges STR, which are generated between the ground electrode protrusion portion 200 and the cylindrical tip portion 111 when the high-frequency high-voltage output from the high-voltage AC power supply is applied.

Due to this configuration, not only is the electric field concentrated at the ground electrode protrusion portion 200, but also the streamer discharges STR are produced within a specific wide range of positions. As illustrated in FIG. 3, that range includes not only the second discharge space 131, but also extends axially to either side of the ground electrode protrusion portion, into the first discharge space and into the combustion chamber 51. Hence when a fuel/air mixture is introduced into the combustion chamber and thus enters the first and second discharge spaces, the mixture can react directly with the streamer discharges within that wide range, to quickly produce an initial-stage flame which spreads to the interior of the combustion chamber, thereby reliably achieving ignition.

In addition to the functions of the ground electrode cylindrical portion 121 and ground electrode tip portion 120, the ground electrode 12 also serves as a housing which covers a part of the external peripheral circumference of the central dielectric body 11, and to also (by engagement of a screw thread) serves to attach the ignition apparatus 1 to the engine 5. As well as being mechanically attached, the ground electrode 12 is thereby also electrically connected to the engine 5, and so connected to the ground potential of the high-voltage AC power supply.

The functions of a housing and of a ground terminal are thus performed by the is ground electrode 12 as a single unit.

Using the axial position of the discharge space base face 112 as a reference position, and designating the length from that reference position to the tip end of the center electrode discharge portion 100 as the center electrode discharge portion length $L_{100}$, the length from the reference position to the tip end of the ground electrode tip portion 120 as the ground electrode tip position length $L_{140}$, the separation distance between the outer circumferential face of the dielectric body cylindrical tip portion 111 and the inner circumferential face of the ground electrode protrusion portion 200 as the second discharge gap $GP_{131}$, and the axial-direction width of the ground electrode protrusion portion 200 as the protrusion portion formation width $T_{200}$, the following relationship is established:

$$GP_{131}+T_{200}<L_{140}<L_{100}$$

It has been found that this enables a higher lean-limit value of A/F ratio (i.e., maximum A/F ratio providing stable ignition) than has been possible in the prior art.

Furthermore the following relationship is preferably established:

$$\tfrac{1}{3}L_{100}\leq L_{140}\leq \tfrac{4}{5}L_{100}$$

That is, the ground electrode protrusion portion 200 should be located at an axial position that is approximately midway along the center electrode discharge portion 100. It has been found that this enables the lean-limit value of A/F ratio to be further increased.

The volume of the first discharge space 130 is preferably made no greater than 300 $mm^3$. If that volume is exceeded, the heat produced by a flame which is produced within the interior of the first discharge space 130 at commencement of combustion of the fuel/air mixture may cause excessive heating of the central dielectric body 11, which can result in occurrence of pre-ignition. Alternatively, if that volume size is exceeded the thermal energy of the flame may be dispersed, such that the flame does not spread into the combustion chamber 51 for igniting the fuel/air mixture therein. This can result in ignition becoming unstable.

Moreover, as has been shown by results of experiments it is necessary for the discharge chamber length $L_{130}$ of the first discharge space 130 to at least be longer than the discharge gap $GP_{130}$. Thus the volume of the first discharge space 130 must be at least greater than some specific value, for example, 15 $mm^3$.

On the other hand, the following relationship is preferably established between the first discharge gap $GP_{130}$ and the second discharge gap $GP_{131}$, to obtain the full effects of is the embodiment:

$$\tfrac{1}{4}GP_{130}\leq GP_{131}\leq \tfrac{3}{4}G_{130}$$

If that relationship is not adhered to, such that the second discharge gap $GP_{131}$ is made excessively narrow, then the streamer discharges will begin to occur at an excessively low value of drive voltage, causing a deterioration of ignition performance. On the other hand if the second discharge gap $GP_{131}$ is made excessively wide, the effect of increasing the electric field concentration within that gap will be reduced, and the ignition performance will become similar to the case in which the ground electrode protrusion portion 200 is omitted.

The center electrode 10 is formed of a material having high electrical conductivity, with an axially elongated shape, and includes the center electrode discharge portion 100, a center electrode coupling portion 101, a center electrode stem portion 102, and a center electrode terminal 103.

Suitable types of material for forming the center electrode 10, which provide high resistance to heat together with good electrical conductivity, include nickel alloy, or a combination of nickel alloy with a metal having high electrical conductivity such as copper.

For ease of manufacture, the center electrode discharge portion 100 and the center electrode stem portion 102 are formed respectively separately, and an electrically conducting path is formed through them via the center electrode coupling portion 101.

The hatched-line portion of the center electrode discharge portion 100 shown in FIG. 3 (which does not indicate a separate part of the center electrode) indicates the axial range within which discharge can occur between the center electrode discharge portion 100 and the ground electrode protrusion portion 200, via the dielectric cylindrical tip portion 111. The center electrode discharge portion 100 is electrically connected to the center electrode terminal 103 via the center electrode stem portion 102 and the center electrode coupling portion 101. The center electrode terminal 103 is connected to receive the high-frequency high-voltage output from the external ECU 30, which is thereby applied between the center electrode discharge portion 100 and the ground electrode protrusion portion 200.

The central dielectric body 11 is formed of a dielectric material having a high resistance to heat, such as alumina, zirconia, etc. In addition to the dielectric termination portion 110, the cylindrical tip portion 111 and the discharge space base face 112, the central dielectric body 11 includes an electrode retaining portion 113, an expanded-diameter portion 114, a head portion 115, center electrode through-holes 116 and 118, and an electrode retaining face 117.

The expanded-diameter portion 114 is held retained in the ground electrode 12, restrained against upward or downward movement by two sealing members 160 and 161.

The sealing members 160 and 161 are of usual type, having a substantially annular shape, formed of metal or of a molded powder material, etc., and provide hermetic sealing.

With this embodiment, only a base (upper) portion of the outer surface of the head portion 115 of the center electrode 11 is formed with circular corrugations, for increasing the length of an electrical resistance path over that surface. However it would be equally possible to form such corrugations over the entire r surface of the head portion 115 between the center electrode terminal 103 and the ground electrode 12.

At the time of manufacture, the center electrode 10, of elongated form as described above, is inserted through the center electrode through-holes 116 and 118 of the central dielectric body 11, and is caught (retained) by engagement of the center electrode coupling portion 101 against the electrode retaining face 117 of the central dielectric body 11.

In addition to the ground electrode tip portion 120 and the ground electrode cylindrical portion 121, the ground electrode 12 includes a screw thread 122, a catch portion 123, a tightening portion 124 and a hexagonal outer portion 125, and is formed of metal such as steel, nickel, stainless steel, etc. The ground electrode tip portion 120, as described above, has a substantially annular shape and protrudes beyond the inner surface of the cylinder head 50 into the combustion chamber 51, exposed to the interior of the combustion chamber 51 along a predetermined length L120. The ground electrode cylindrical portion 121 (in conjunction with the cylindrical tip portion 111 and discharge space base face 112) forms the first discharge space 130. The catch portion 123 engages against the expanded-diameter portion 114 of the central dielectric body 11. The tightening portion 124 tightly retains the expanded-diameter portion 114 of the central dielectric body 11, acting on the sealing member 160. The hexagonal outer portion 125 of the ground electrode 12 serves for screw-attaching the ignition apparatus 1 in the cylinder head 50, to using the screw thread 122.

Since the ignition apparatus 1 does not generate plasma at a high temperature during the electrical discharges, only a small degree of wear of the electrodes can be expected to occur due to effects of heat. Hence it is not necessary to use any special types of material which is highly resistant to effects of heat, such as iridium, etc., to form the center electrode discharge portion 100, the ground electrode tip portion 120, etc., and the types of material used in conventional spark plugs can be selected.

The engine 5 of this embodiment will be briefly described. This is a four-stroke internal combustion engine, with each of the cylinders covered by the cylinder head 50, and having a corresponding combustion chamber 51 formed between the cylinder head 50 and the upper face of the corresponding piston 52. Each piston 52 is supported for reciprocating motion within the corresponding cylinder. Each cylinder is provided with an intake port 501 formed in the cylinder head 50, which is opened/closed by an intake valve 502, and an exhaust port 503 which is opened/closed by an exhaust valve 504.

At each of respective ignition timings, determined in accordance with the running condition of the engine 5, the ECU 30 of the external power supply 3 triggers the high-voltage AC power supply 31 to generate a short-duration high-voltage AC burst having the form shown in FIG. 2, which is applied to the ignition apparatus 1. This causes a non-equilibrium plasma (otherwise known as a non-thermal plasma) to be produced within the first discharge space 130, the second discharge space 131 and the combustion chamber 51, thereby igniting the fuel/air mixture within the combustion chamber 51.

It should be noted that the invention is not limited to any specific type of internal combustion engine, and furthermore could be applied to engines utilizing various different types of fuel, i.e., gasoline or diesel engines, or engines utilizing a gas (e.g., hydrogen) as fuel, etc.

Each high-voltage AC burst (preferably having an AC frequency f within the range 85 kHz~850 kHz and peak voltage $V_{pp}$ within the range 20 kV~50 kV) has the form shown in FIG. 2, delivering a fixed amount of energy (for example, 1 mJ) in each period of the AC voltage.

Streamer discharges are thereby repetitively produced, synchronized with the AC voltage (i.e., synchronized with peak voltage occurrences). Hence the higher the AC frequency the higher is the number of streamer discharges per unit time interval, and thus to the greater becomes the energy consumed in effecting ignition.

The partial cross-sectional view of FIG. 3 illustrates the effects obtained by the embodiment, with respect to the extent and position of a discharge. The diagram conceptually illustrates the streamer discharges STR generated between the inner circumferential face of the ground electrode protrusion portion 200 and the outer circumferential face of the dielectric body cylindrical tip portion 111, when a specific high-voltage high-frequency AC (300 kHz, 300 mJ/1.0 ms) is applied to the center electrode 10.

With this embodiment, the ground electrode protrusion portion 200 forms a second discharge gap $GP_{131}$ (shown in FIG. 1) of the second discharge space 131 which is more narrow than the discharge gap 130 of the first discharge space 130. As a result, electric field concentration occurs at the inner circumferential face of the ground electrode protrusion portion 200. Streamer discharges are thereby produced within a large region, which encloses that circumferential face of the ground electrode protrusion portion 200 and a wide area of the surface of the cylindrical tip portion 111, that area extending towards the tip end and towards the base end of the cylindrical tip portion 111 as illustrated in FIG. 3.

Since the cylindrical tip portion 111 and the center electrode discharge portion 100 (covered by the dielectric termination portion 110) extend farther into the combustion chamber 51 than does the ground electrode tip portion 120, the streamer discharges enter the interior of the combustion chamber 51 as well as the first discharge space 130. Hence, multiple reactions occur over a wide region, between the non-equilibrium plasma and the fuel/air mixture. It has been confirmed by the assignees of the present invention, based on extensive testing, that this results in highly effective ignition performance.

Figure 4A:
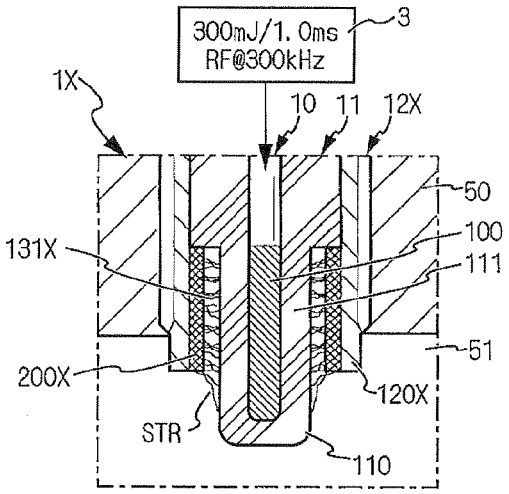
FIGS. 4A, 4B and 4C are respective partial cross-sectional views showing the main components of first, second and third comparison examples, each comparison example being a modified form of the first embodiment which does not provide the effects of the first embodiment.
Figure 4B:
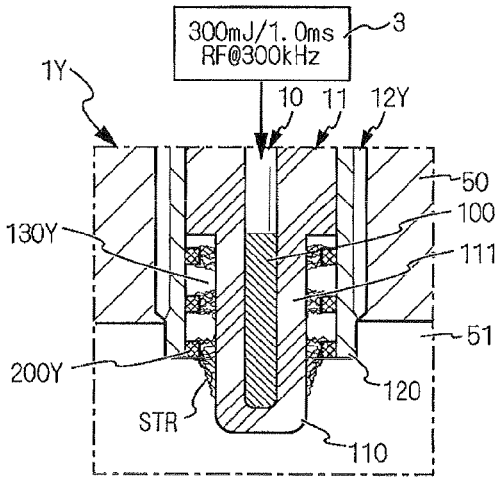
Figure 4C:
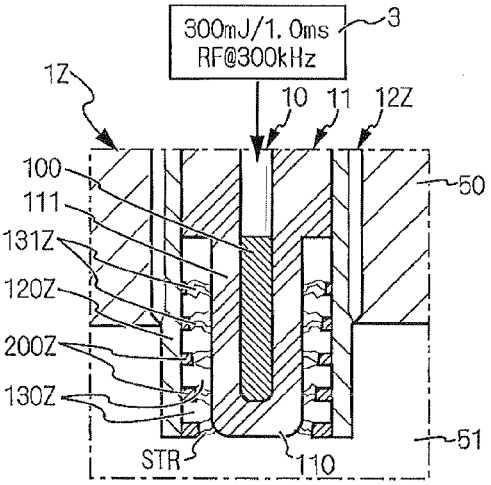

Referring to FIGS. 4A, 4B and 4C, ignition apparatuses 1X, 1Y and 1Z respectively are shown, used as comparison examples 1, 2 and 3 respectively for demonstrating the effects of the present invention, i.e., comparison examples which do not provide the advantages of the present invention. The same reference numerals are assigned as for the ignition apparatus 1 of the first embodiment above, and only the points of difference from the first embodiment are described where necessary.

In the case of the ignition apparatus 1X, the ground electrode protrusion portion 200X extends uniformly over the entirety of the ground electrode tip portion 120 and the ground electrode cylindrical portion 121, forming a discharge gap that is smaller overall than that of the ignition apparatus 1. Specifically, the discharge gap $GP_{131}$ is set as 1 mm.

In the case of the ignition apparatus 1Y, not only is a annular-shape ground electrode protrusion portion formed in the ground electrode tip portion 120 as for the ignition apparatus 1 of the first embodiment, but also a plurality of similar annular-shape ground electrode protrusion portions 200Y are formed successively arrayed along the axial direction, each opposing the central dielectric body 11.

In the case of the ignition apparatus 1Z, a plurality of annular-shape ground electrode protrusion portions 120Z are formed as for the ignition apparatus 1Y, however these successively increase in (radial-direction) protrusion extent, in accordance with position along the axial direction. Specifically, the sizes of the respective discharge gaps gp131 successively decrease towards the tip end of the central dielectric body 11 in the sequence: 0.75 mm, 1.00 mm, 1.25 mm, 1.5 mm.

Figure 5A:
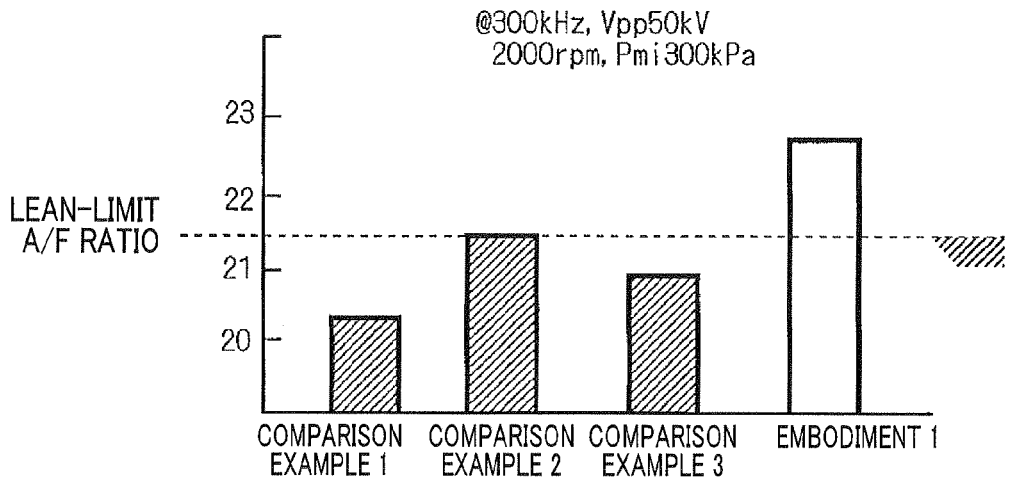
FIG. 5A shows respective values of lean-limit A/F ratio that are attainable with the first embodiment and with the first, second and third comparison examples.

FIG. 5A shows the results of lean-limit A/F ratio tests performed for comparing the ignition apparatus 1 with the ignition apparatuses 1X, 1Y and 1Z, under the same test conditions (AC frequency 300 kHz, peak voltage Vpp=50 kV). As shown, a substantially higher value of lean-limit air/fuel ratio can be achieved by using the ignition apparatus 1 of the first embodiment than is possible with the comparison examples 1 or 3 (ignition apparatuses 1X or 1Z).

Figure 5B:
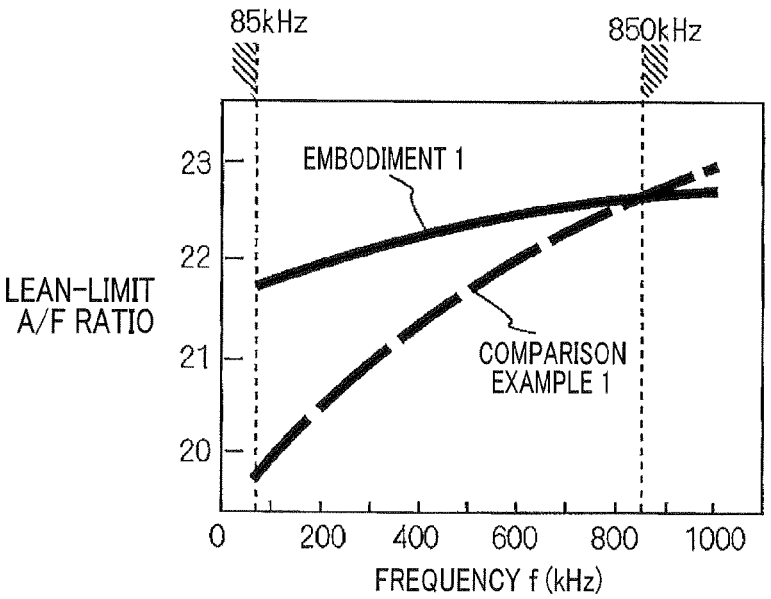
FIG. 5B shows a variation of values of lean-limit A/F ratio with respect to frequency of the high-frequency power source, for the first embodiment and for the first comparison example respectively.

FIG. 5B shows the effects of varying the AC frequency upon the lean-limit air/fuel ratio, for the case of comparison example 1 (ignition apparatus 1X) and the ignition apparatus 1 of the first embodiment, respectively. As shown, with the comparison example 1, the lean-limit air/fuel ratio falls considerably as the AC frequency is reduced within the range 85 kHz to 850 kHz. However with the ignition apparatus 1 of the first embodiment, the lean-limit air/fuel ratio remains stable over a wide range of AC frequency values.

In the case of comparison example 3, when the combustion chamber pressure is high at each ignition timing (i.e., when the engine is operating under high load) it is found that the electric charge is concentrated near the tip end of the ignition device, where the discharge gap is most narrow, as is found with the first embodiment, and a high value of lean-limit air/fuel ratio may be achieved. However when the engine is operated under a low-load condition, so that the combustion chamber pressure is low at each ignition timing, discharge occurs across all of the discharge gaps concurrently, so that the discharge energy density becomes lowered. Hence the lean-limit air/fuel ratio becomes lower than is possible with the first embodiment.

Moreover with comparison example 3, when the engine operating condition varies between operating under high load and low load conditions, this causes variations in the positions of the ground electrode protrusion portions 120Z where streamer discharges occur. Furthermore even when the engine operating condition remains unchanged, the lean-limit air/fuel ratio may vary between higher and lower values. Hence, stable ignition is at a high value of lean-limit air/fuel ratio cannot be ensured with the configuration of ignition apparatus 1Z.

The results of tests for confirming the effects of varying the discharge gap will be further described referring to FIG. 5A. Here "embodiment 1" designates the lean-limit air/fuel ratio test results obtained for the ignition apparatus 1 of the first embodiment, when measured under the aforementioned AC drive condition (AC frequency 300 kHz, peak voltage Vpp=50 kV), and with the engine running at 2000 rpm with an average effective combustion chamber pressure Pmi of 300 kPa, i.e., with the engine operating under a comparatively low load.

In the case of comparison example 1 (obtained for ignition apparatus 1X) the discharge gap is comparatively narrow overall, as shown in FIG. 4A. The test result shown for the comparison example 1 in FIG. 5A and for the comparison example 2 (ignition apparatus 1Y shown in FIG. 4B) were obtained under the same AC drive condition as described above.

As shown by these test results, a substantially higher lean-limit air/fuel ratio was achieved with embodiment 1 than was achieved for either of the comparison examples 1 or 2.

The effects of varying the power source frequency f with the present invention will be described referring to FIG. 5B. As shown, in the case of comparison example 1 (ignition apparatus 1X) the lean-limit air/fuel ratio becomes rapidly decreased in accordance with lowering of the power source frequency f. However in the case of the first embodiment (embodiment 1) the lean-limit air/fuel ratio remains at a substantially high level as the power source frequency f is lowered.

Hence it has been found that, for the same amount of electrical energy consumed in effecting ignition (that is, for the same value of power source frequency f), the first embodiment of the invention enables stable ignition to be maintained at a higher limit value of A/F ratio than is possible with a configuration such as that of ignition apparatus 1X. Alternatively stated, if it is necessary to employ a high value of power source frequency f such as 850 kHz, then even if a high lean-limit air/fuel ratio can be achieved, a high level of electrical energy must be supplied, originating from a power source such as the vehicle engine. Since only a limited amount of energy is available for the electrical system of a vehicle, use of such a high frequency is a disadvantage, and may not be practicable.

Figure 6:
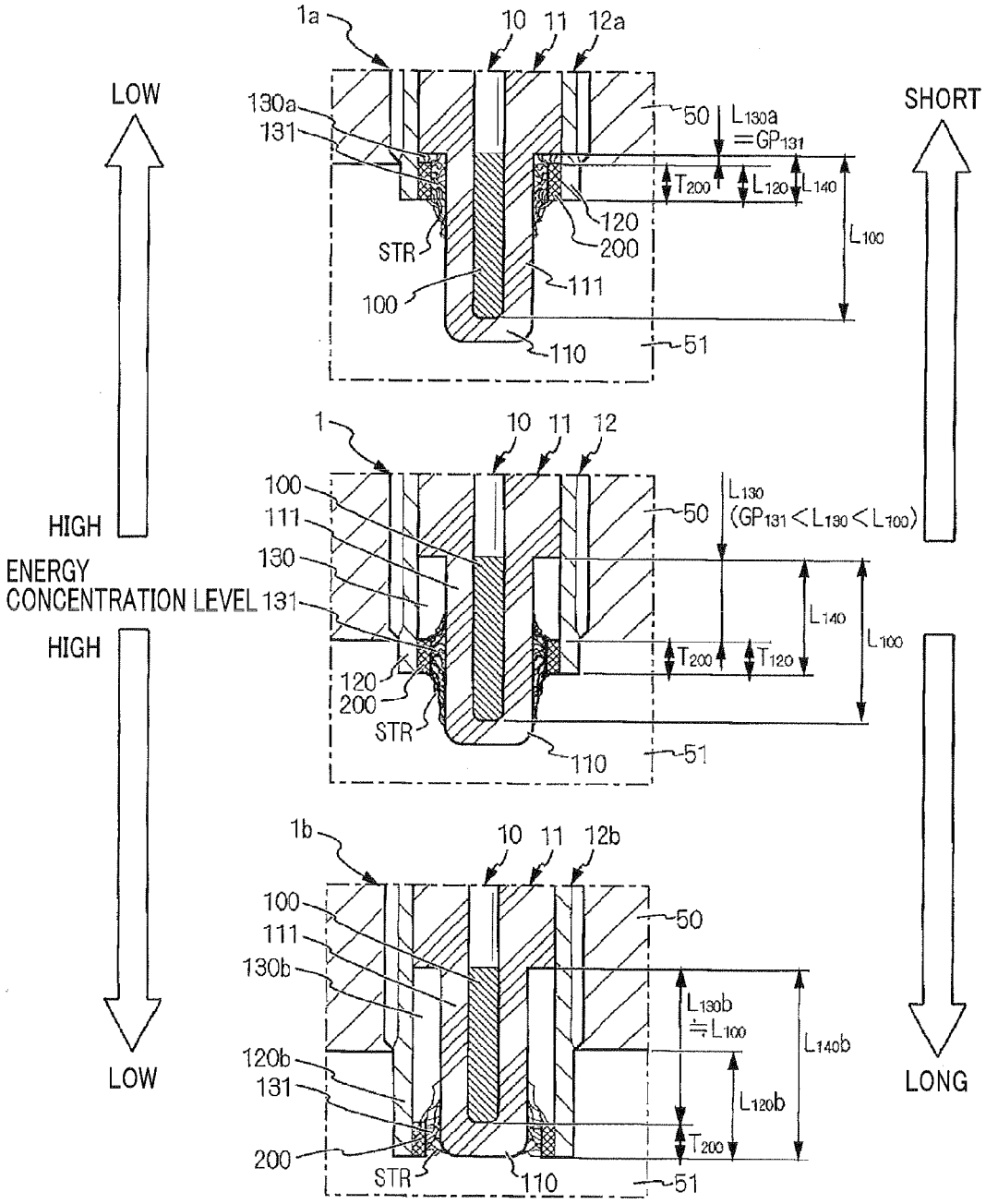
FIG. 6 is a conceptual diagram for illustrating results of varying the configuration of an ignition apparatus from that of the first embodiment.
Figure 7:
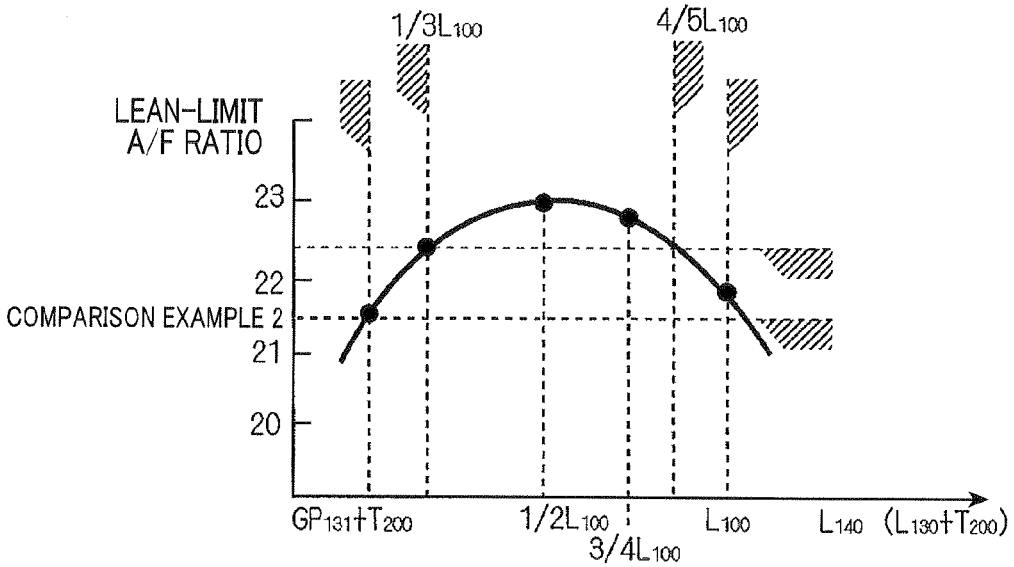
FIG. 7 is a graph showing test results corresponding to the contents of FIG. 6.

FIGS. 6 and 7 illustrate the results of tests performed to investigate optimum conditions for the volume of the first discharge space 130 and the (axial) position of the ground electrode protrusion portion 200, of the first embodiment. FIG. 6 conceptually illustrates the results of tests which varied the volume of the first discharge space 130 by varying the position of the ground electrode protrusion portion 200 (i.e., varying the ground electrode tip position length $L_{140}$), In the case of the ignition apparatus 1*a* shown in FIG. 6, the discharge chamber length $L_{130}$ of the discharge space 130*a* is made equal to the size of the second discharge gap $GP_{131}$ (e.g., 1 mm).

In the case of the ignition apparatus 1*b*, the position of the tip end of the ground electrode tip portion 120 is made identical to that of the tip end of the dielectric termination portion 110, and the discharge space length L130*b* is made equal to the center electrode discharge portion length $L_{100}$.

FIG. 7 shows the results of tests to investigate the effects upon the lean-limit air/fuel ratio of varying the ground electrode tip position length $L_{140}$, under the condition that the second discharge gap $GP_{131}$ and the protrusion portion formation width $T_{200}$ are held constant (at the values $T_{200}$=2 mm, $GP_{131}$=1 mm).

It has been found that if the value of the ground electrode tip position length $L_{140}$ is set within a range whereby $L_{140}$ exceeds the total of the second discharge gap $GP_{131}$ and the protrusion portion formation width $T_{200}$, (i.e., ($GP_{131}+T_{200}<L_{140}$) while also $L_{140}$ does not exceed the center electrode discharge portion length $L_{100}$ (i.e., $L_{140}<L_{100}$), then values of lean-limit air/fuel ratio can be achieved which are higher than that obtained with the comparison example 2 above. Specifically, the variation of the lean-limit air/fuel ratio with respect to the size of the ground electrode tip position length $L_{140}$ has a convex parabolic characteristic, as shown in FIG. 7, and it has been found that maximum values of lean-limit A/F ratio are obtained using a value of $L_{140}$ within the range from ⅓ to ⅘ of $L_{100}$.

Preferably, the protrusion portion formation width $T_{200}$ is set within the range 0.5 mm~2.5 mm. If $T_{200}$ is made more narrow than 0.5 mm, then the electric field concentration becomes lowered, while also there is a danger that the mechanical strength to may become reduced excessively. Conversely, if $T_{200}$ exceeds 2.5 mm, there is a danger that the effect of increasing the energy density by electric field concentration will become lowered.

If the volume of the first discharge space 130 is reduced below that of the ignition apparatus 1*a* shown in FIG. 6 while also the discharge chamber length $L_{130}$ is made shorter than the second discharge gap $GP_{131}$, it becomes difficult to produce electrical discharge between the ground electrode protrusion portion 200 and the surface of the cylindrical tip portion 111. The lean-limit air/fuel ratio thereby becomes less than for comparison example 2 (ignition apparatus 1Y of FIG. 4B). Conversely, if the volume of the first discharge space 130 is increased by making the ground electrode tip position length $L_{140}$ greater than the center electrode discharge portion length $L_{100}$, then in that case too, the lean-limit air/fuel ratio will become less than that obtained with comparison example 2.

That is, the energy concentration level reaches a peak when the ground electrode tip position length $L_{140}$ is approximately ½ of the center electrode discharge portion length $L_{100}$. It has been found that the further $L_{140}$ is changed from that value (i.e., so that the tip of the ground electrode tip portion 120 becomes axially shifted towards the tip of the center electrode discharge portion 100 or towards the base end of the center electrode discharge portion 100), the energy concentration level becomes lowered accordingly.

In the following, second to seventh embodiments (1*c*~1*h*) which are respective alternative forms of the ignition apparatus 1 of the first embodiment will be described. Identical reference numerals to those used for the ignition apparatus 1 are used in describing these alternative embodiments, but with each component which is specific to a particular alternative embodiment being designated by an alphabetic letter attached to the corresponding reference numeral. The descriptions are centered on only those features which are specific to each alternative embodiment.

Figure 8A:
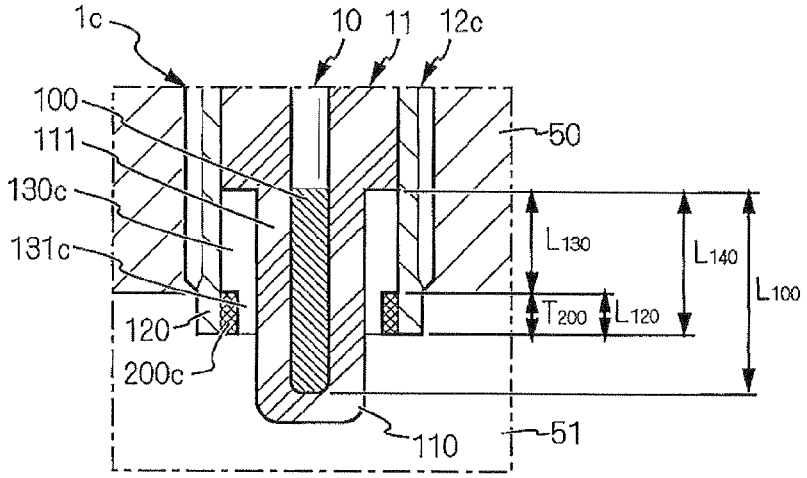
FIG. 8A is a cross-sectional view showing the main components of a second embodiment of an ignition apparatus.
Figure 8B:
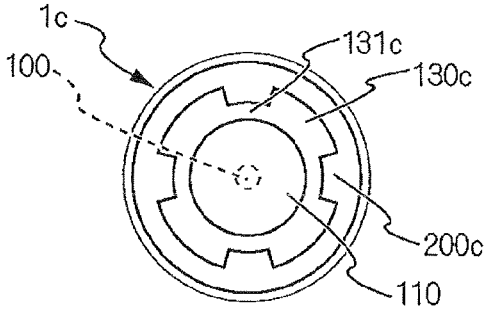
FIG. 8B is a plan view of the second embodiment, as viewed towards the tip end.

Firstly referring to FIGS. 8A and 8B, a second embodiment designated as ignition apparatus 1*c* is shown. In the case of ignition apparatus 1 above, the entire inner circumferential face of the ground electrode protrusion portion 200 protrudes uniformly towards the outer circumference the dielectric body cylindrical tip portion 111. In the case of the ignition apparatus 1*c*, as illustrated in the plan view of FIG. 8B (taken along the axial direction, towards the dielectric termination portion 110) only segments of the ground electrode protrusion portion 200*c* protrude towards the dielectric body cylindrical tip portion 111, i.e., with a circumferential face portion of each segment being separated from the cylindrical tip portion 111 by the second discharge gap. This configuration enables the energy density to be further increased, so that further improvement in ignition performance can be expected.

Figure 9:
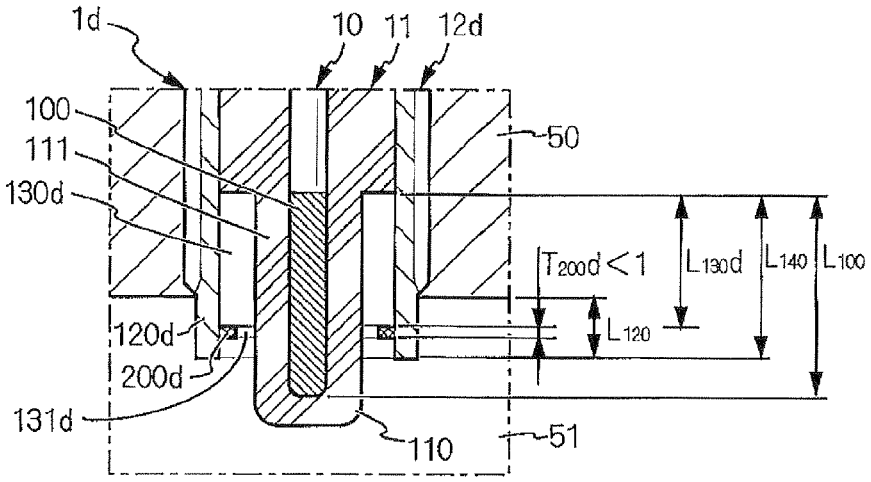
FIG. 9 is a partial cross-sectional view showing the main components of a third embodiment of an ignition apparatus.

Referring to the partial cross-sectional view of FIG. 9, a third embodiment is designated as the ignition apparatus 1*d* is shown. In the case of the ignition apparatuses 1 and 1*c* of the first and second embodiments, the protrusion length $L_{120}$, (the length for which the ground electrode tip portion 120 is exposed to the interior of the combustion chamber 51) is set within a similar range to the protrusion portion formation width $T_{200}$, and all or part of the inner circumference of the ground electrode protrusion portion 200 protrudes towards the dielectric body cylindrical tip portion 111. The third embodiment shown in FIG. 9 differs in that the ground electrode protrusion portion 200*d* has a thin annular shape, with the protrusion portion formation width $T_{200d}$ being made substantially smaller than the protrusion length $L_{120}$, (i.e., $T_{200d}$ is made no greater than 1 mm).

This embodiment provides similar effects to those of the first or second embodiment. However in addition with the third embodiment, not only is the electric field concentration increased by comparison with the first or second embodiment, but also thermal capacity of the ground electrode protrusion portion 200*d* is reduced, so that energy loss can be further reduced.

Figure 10:
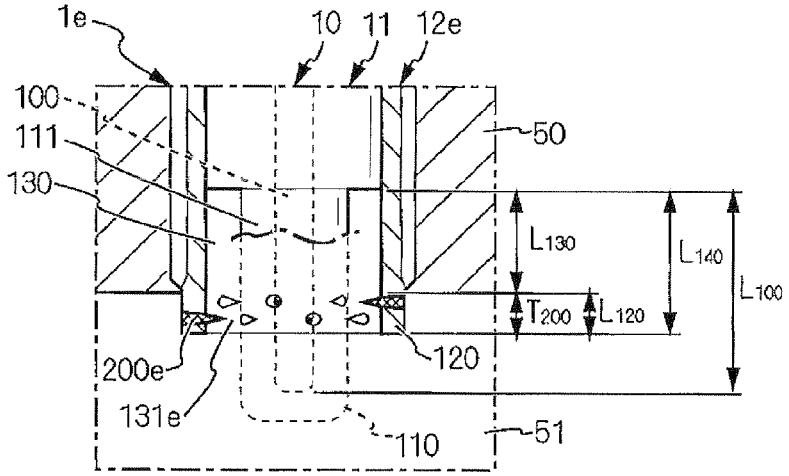
FIG. 10 is a partial cross-sectional partial view of the main components of a fourth embodiment of an ignition apparatus.

Referring to the partial cross-sectional view of FIG. 10, a fourth embodiment designated as ignition apparatus 1*e* is shown. With this embodiment, a plurality of ground electrode protrusion portions 200*e*, each of conical shape, are arrayed around the inner circumferential face of the ground electrode tip portion 120, within an axial range designated as the protrusion portion formation width $T_{200e}$, with the apex of each ground electrode protrusion portion 200*e* protruding radially towards the cylindrical tip portion 111.

The ground electrode protrusion portions 200*e* are preferably arrayed at positions which are staggered with respect to axial directions. This is done to ensure that the origination points of the streamer discharges are uniformly distributed circumferentially, within the range of the protrusion portion formation width $T_{200e}$. This enables the streamer discharges to extend over a wide range, extending towards the tip end and towards the base end of the cylindrical tip portion 111, i.e., an axial range which encloses the array of ground electrode protrusion portions 200*e*.

Hence this embodiment can provide similar effects to those of the first embodiment. However in addition, due to the conical shape of each of the ground electrode protrusion portions 200*e*, an even higher degree of localized electric field concentration and greater energy density can be expected to be obtained.

Figure 11:
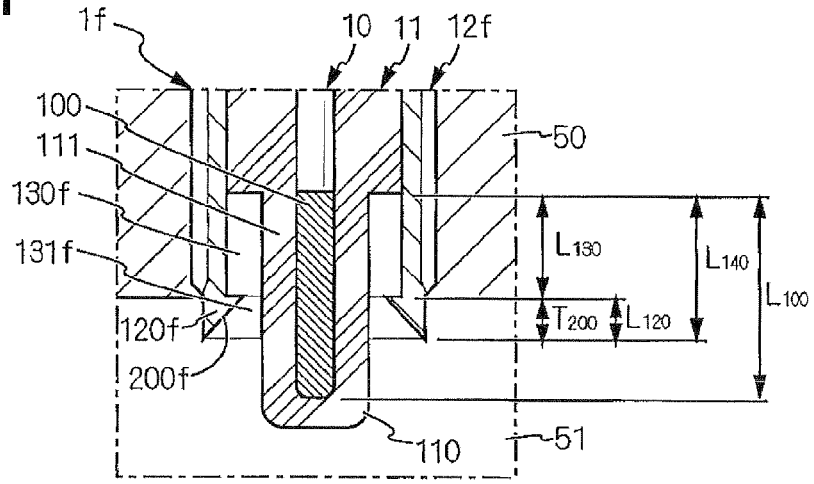
FIG. 11 is a partial cross-sectional view showing the main components of a fifth embodiment of an ignition apparatus.

Referring to the partial cross-sectional view of FIG. 11, a fifth embodiment designated as the ignition apparatus 1*f* is shown.

The configuration of this embodiment is similar to that of the ignition apparatus 1 of the first embodiment, but differs in that the ground electrode protrusion portion 200*f* of the ignition apparatus 1*f* and the lower end of the ground electrode tip portion 120*f* are tapered, that is, are formed with a circular bevelled face which increases in diameter towards the tip end (i.e., increases in diameter in accordance with closeness to the interior of the combustion chamber 51), with the base end of the bevelled face protruding towards the dielectric body cylindrical tip portion 111, and with a discharge space 130*f* thereby formed between that bevelled face and the cylindrical tip portion 111.

With this embodiment, in addition to the effects provided by the ignition apparatus 1, since the part of the ground electrode protrusion portion 200*f* which is closest to the central dielectric body 11 is formed as a circumferentially extending sharp edge, an even greater electric field concentration can be attained, so that more efficient use of electric discharge energy can be expected. In addition, since the ground electrode tip portion 120*f* successively increases in internal diameter towards the interior of the combustion chamber 51, an initial flame which is produced by ignition within the first discharge space 130*f* can rapidly propagate into the combustion chamber 51, so that improved ignition performance can be expected.

Figure 12:
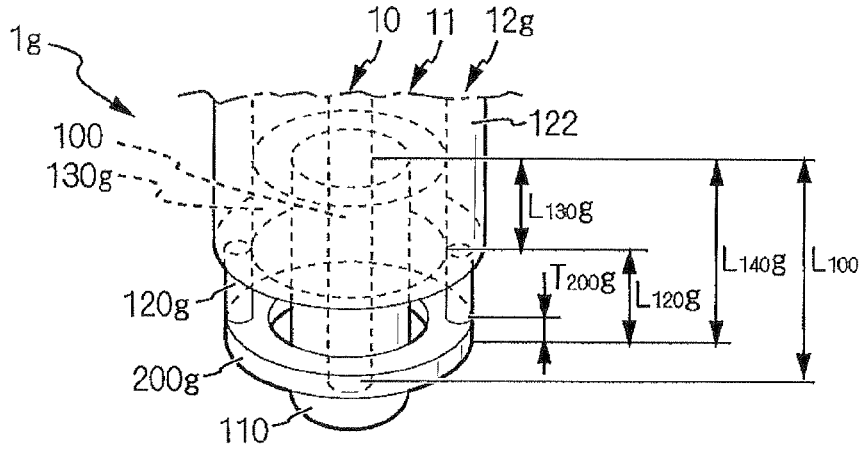
FIG. 12 is a partial cross-sectional view showing the main components of a sixth embodiment of an ignition apparatus.

Referring to the partial oblique view of FIG. 12, a sixth embodiment designated as the ignition apparatus 1*g* will be described. With this embodiment, a plurality of ground electrode tip portions 120*g* each having cylindrical form and being axially oriented are supported by a ground electrode cylindrical portion 121*g* of a ground electrode 12*g*, with an annular-shape ground electrode protrusion portion 200*g* being held suspended from the tip ends of the ground electrode tip portions 120*g*. The ground electrode tip portions 120*g* are axially located approximately midway along the dielectric body cylindrical tip portion 111. A discharge space 130*g* is formed between the ground electrode cylindrical portion 121*g* and the dielectric body cylindrical tip portion 111.

With such a configuration, as for the ignition apparatus 1 above, the streamer discharges are concentrated in a wide range which extends on both sides of the ground electrode protrusion portion 200*g*, and in which there is high energy density. However in addition with the sixth embodiment, the fuel/air mixture can readily pass between the combustion chamber 51 and the discharge space 130*g*, so that a flame which is ignited in is the discharge space 130*g* can rapidly spread into the combustion chamber 51. Hence, improved ignition performance can be expected.

Figure 13:
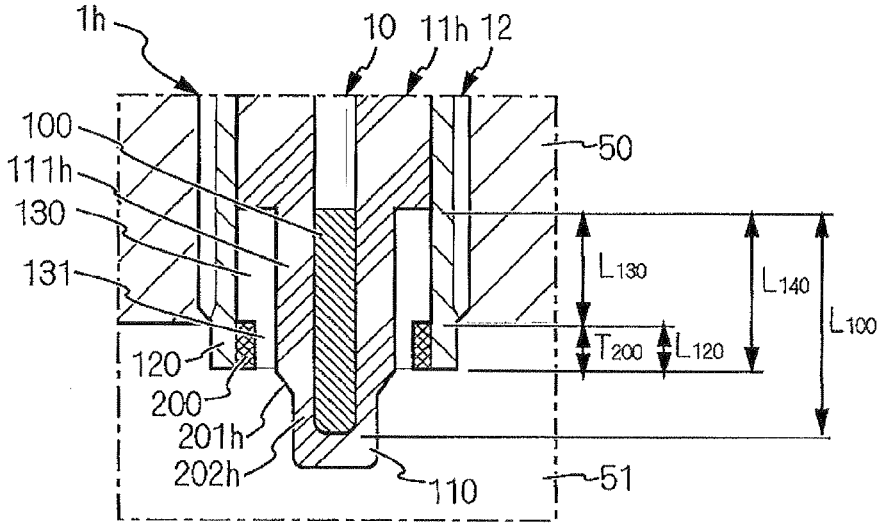
FIG. 13 is a partial cross-sectional view showing the main components of a seventh embodiment of an ignition apparatus.

A seventh embodiment, designated as the ignition apparatus 1*h*, will be described referring to the partial cross-sectional view of FIG. 13. This embodiment is modified from the configuration of the ignition apparatus 1 above in that the outer diameter of the cylindrical tip portion 111*h* of the central dielectric body 11*h* becomes smaller towards the tip end. Specifically, a tapered portion 201*h* commences at the axial position of the tip end of the ground electrode 12, and ends at a thin-wall portion 202*h*, which extends to the tip end of the central dielectric body 11*h*.

With this embodiment, in addition to the effects obtained with the first embodiment, the surface potential of the thin-wall portion 202*h* is increased relative to other parts of the central dielectric body 11*h*, thereby increasing the energy density of those streamer discharges which enter the combustion chamber 51. In addition, since a wider aperture results from the formation of the thin-wall portion 202*h*, an initial flame that is produced by ignition of the fuel/air mixture within the discharge space 130 can more rapidly spread into the combustion chamber 51. Due to these factors, further improvement in ignition performance can be expected.

If the overall thickness of the cylindrical tip portion 111*h* were to be reduced, the insulation effectiveness (level of withstanding voltage) of the dielectric material at positions opposite the ground electrode protrusion portion 200 would be reduced. However by reducing the thickness of only a portion of the cylindrical tip portion 111*h* which is axially separated from the ground electrode protrusion portion 200, destruction of the dielectric material can be avoided.

The invention is not limited to the above embodiments, and various modified forms of the embodiment or combinations of features from respective embodiments may be envisaged which fall within the scope claimed for the invention, as set out in the appended claims.

What is claimed is:

1. An ignition apparatus for igniting a fuel/air mixture in a combustion chamber of an internal combustion engine, the ignition apparatus comprising:

at least a center electrode elongated along an axial direction, a central dielectric body of hollow cylindrical form disposed covering the center electrode, a ground electrode including a cylindrical portion having hollow cylindrical form and disposed coaxially enclosing the central dielectric body, separated from at least a part of thereof by a specific gap, and an AC power supply configured to repetitively apply an AC voltage having a specific value of frequency and a specific high value of peak voltage between the center electrode and the ground electrode, wherein:

the central dielectric body includes a cylindrical tip portion extending to a tip end thereof, of smaller external diameter than a remaining part of the central dielectric body and separated from an inner circumferential face of the ground electrode by a first is discharge gap, and a discharge space base face extending between the cylindrical tip portion and a remaining part of the central dielectric body, whereby a first discharge space having the first discharge gap is delimited by the inner circumferential face of the ground electrode, the discharge space base face and the outer circumferential face of the cylindrical tip portion of the central dielectric body;

an annular-form tip portion of the ground electrode, extending to the tip end of the ground electrode, is open to the interior of the combustion chamber and protrudes into the combustion chamber for a specific protrusion distance;

a ground electrode protrusion portion having a specific axial-direction width is disposed around an inner circumference of the tip portion of the ground electrode, adjacent to the tip end of the ground electrode, with at least a part of an inner circumferential face of the ground electrode protrusion portion protruding towards the cylindrical tip portion of the central dielectric body to thereby form a second discharge space having a second discharge gap, the second discharge gap being narrower than the first discharge gap, and the second discharge space extending axially from the tip end of the first discharge space; and, a portion of the center electrode, extending to a tip end thereof, protrudes into the combustion chamber for a greater distance than the protrusion distance of the ground electrode tip portion.

2. The ignition apparatus as claimed in claim 1, wherein the ground electrode protrusion portion is formed with a uniform annular shape, and wherein the second discharge gap is a separation distance between an inner circumferential face of the ground electrode protrusion portion and the cylindrical tip portion of the central dielectric body.

3. The ignition apparatus as claimed in claim 1, wherein the ground electrode protrusion portion is formed as a plurality of identical circumferentially distributed individual protrusion portions and wherein the second discharge gap is a separation distance between each of respective inner circumferential faces of the individual protrusion portions and the cylindrical tip portion of the central dielectric body.

4. The ignition apparatus as claimed in claim 1, wherein designating the discharge space base face as a reference face, designating the axial distance from the reference face to the tip of the center electrode discharge portion as $L_{100}$, designating the length from the reference face to the tip of the ground electrode as $L_{140}$, designating the width of the second discharge gap as $GP_{131}$, and designating the axial-direction width of the ground electrode protrusion portion as $T_{200}$, the following relationship is established:

$$(GP_{131}+T_{200})<L_{140}<L_{100}.$$

5. The ignition apparatus as claimed in claim 1, wherein designating the discharge space base face as a reference face, designating the axial distance from the reference face to the tip of the center electrode discharge portion as $L_{100}$, and designating the axial distance from the reference face to the tip of the ground electrode as $L_{140}$, the following relationship is established:

$$(1/3)L_{100}\leq L_{140}\leq(4/5)L_{100}.$$

6. The ignition apparatus as claimed in claim 1, wherein designating the separation distance between an outer circumferential face of the cylindrical tip portion of the central dielectric body and an inner circumferential face of the ground electrode cylindrical portion as $GP_{130}$, and designating the separation distance between an outer circumferential face of the cylindrical tip portion of the central dielectric body and an inner circumferential face of the ground electrode protrusion portion as $GP_{131}$, the following relationship is established:

$$(1/4)GP_{130}\leq GP_{131}\leq(3/4)GP_{130}.$$

7. The ignition apparatus as claimed in claim 1, wherein the frequency of the AC voltage generated by the AC power supply is within a range extending from 85 kHz to 850 kHz.

8. The ignition apparatus as claimed in claim 1, wherein the first discharge space has to a volume of no greater than 300 $mm^3$.

9. The ignition apparatus as claimed in claim 1, wherein the axial-direction width of the ground electrode protrusion portion is substantially smaller than the protrusion distance of the ground electrode tip portion.

10. The ignition apparatus as claimed in claim 1, wherein the ground electrode protrusion portion is implemented as a plurality of conical protrusion arrayed around the inner circumferential face of the ground electrode tip portion, within a specific axial-direction range, with each of respective apexes of the conical protrusions oriented towards the cylindrical tip portion of the central dielectric body.

11. The ignition apparatus as claimed in claim 1, wherein a part of the cylindrical tip portion of the central dielectric body, located in an axial range between the tip end of the central dielectric body and the tip end of the ground electrode, covers the center electrode to a smaller thickness than does a remaining part thereof.

12. The ignition apparatus as claimed in claim 1, wherein the ground electrode protrusion portion is formed with a circular bevelled face, expanding in diameter towards the interior of the combustion chamber.

13. The ignition apparatus as claimed in claim 1, wherein:

the ground electrode protrusion portion is of annular shape, and the tip portion of the ground electrode is formed as a plurality of axially-extending cylindrical portions each supported between the cylindrical portion of the ground electrode and the ground electrode protrusion portion.

* * * * *